United States Patent [19]

Yanagihara et al.

[11] Patent Number: 4,981,836

[45] Date of Patent: Jan. 1, 1991

[54] RECORDING MATERIAL

[75] Inventors: Naoto Yanagihara; Ken Iwakura; Hiroo Fukunaga; Akira Igarashi, all of Shizuoka, Japan

[73] Assignee: Fuji Photo Film Co., Ltd., Kanagawa, Japan

[21] Appl. No.: 431,697

[22] Filed: Nov. 3, 1989

Related U.S. Application Data

[63] Continuation of Ser. No. 176,525, Apr. 1, 1988, abandoned.

[30] Foreign Application Priority Data

Apr. 1, 1987 [JP] Japan ..... 62-80085

[51] Int. Cl.[5] ..... B41M 5/18

[52] U.S. Cl. ..... 503/218; 427/151; 503/220; 503/223

[58] Field of Search ..... 427/151; 428/913, 914; 503/220, 223, 218; 549/307

[56] References Cited

U.S. PATENT DOCUMENTS 4,658,276 4/1987 Kanda et al. ..... 503/220

*Primary Examiner*—Bruce H. Hess

*Attorney, Agent, or Firm*—Sughrue, Mion, Zinn, Macpeak and Seas

[57] ABSTRACT

A recording material is disclosed, which comprises a support having thereon a recording layer comprising at least one electron-donating colorless dye and at least one electron-accepting compound, wherein said electron-donating colorless dye is a fluorene derivative having a substituted amino group at the 3-position and the 5-position or a substituted amino group at the 2-position and the 6-position.

The recording material gives colored portions having light absorption at near infrared region, has improved coloring property and shelf life, and gives colored images having improved stability.

4 Claims, No Drawings

RECORDING MATERIAL

This is a continuation of application Ser. No. 176,525, filed Apr. 1, 1988, now abandoned.

FIELD OF THE INVENTION

This invention relates to a recording material, and more particularly to a recording material using an electron-donating colorless dye and an electron-accepting compound, the recording material giving colored portions having light absorption at near infrared region, having improved coloring property and shelf life, and giving colored images having improved stability.

BACKGROUND OF THE INVENTION

A recording material using an electron-donating colorless dye and an electron-accepting compound is well known as a pressure-sensitive paper, a heat-sensitive paper, a light-sensitive pressure-sensitive paper, an electro thermo-recording paper, etc., as described, e.g., in British Pat. No. 2,140,449, U.S. Pat. Nos. 4,480,052 and 4,436,920, Japanese Patent Publication No. 23922/85, Japanese Patent Application (OPI) Nos. 179836/82, 123556/85, and 123557/85 (the term "OPI" as used herein indicates an "unexamined published Japanese patent application").

These recording materials must have such performance as (1) giving sufficient color density and color sensitivity, (2) forming less or no fog, (3) giving colored material having sufficient fastness, (5) giving high S/N ratio, and (6) giving colored material having sufficiently high chemical resistance but recording materials completely satisfying these requirements have not yet been obtained at present.

In particular, a heat-sensitive recording material generally has a fault of forming fog by the action of solvent, etc., and a fault of causing discoloring or fading of colored materials by the action of fats and oils, chemicals, etc. Thus, when a heat-sensitive recording material is brought into contact with a stationery or office supplies such as a water-color ink pen, an oil ink pen, a fluorescent ink pen, a vermilion inkpad, adhesives, a diazo developer, etc., or cosmetics such as a hand cream, a milky lotion, etc., white portions (background portions) are colored or colored portions are discolored or faded to greatly reduce the commercial value thereof.

Accordingly, the inventors have investigated for obtaining good elements for recording materials and good recording materials by paying attention to the characteristics of electron-donating colorless dyes and electron-accepting compounds, such as the oil solubility, solubility in water, distribution coefficient, pKa, the polarity of substituent, the position of substituent, the crystallinity of a mixture thereof, the change of solubility, etc. Also, recently, the development of a recording material giving colored portions having absorption at infrared regions has been desired.

SUMMARY OF THE INVENTION

The object of this invention is, therefore, to provide a recording material having improved coloring property and shelf life, giving colored images having improved stability, and giving colored portions having light absorption at infrared regions.

It has now been discovered that the aforesaid object of this invention is attained by a recording material comprising a support having thereon a recording layer comprising at least one electron-donating colorless dye and at least one electron-accepting compound, wherein the electron-donating colorless dye is a fluorine derivative having a substituted amino group at the 3-position and the 5-position or a substituted amino group at the 2-position and the 6-position.

DETAILED DESCRIPTION OF THE INVENTION

The fluorene derivative for use in this invention is preferably those shown by the following formula (I) or (II) and more preferably shown by formula (II):

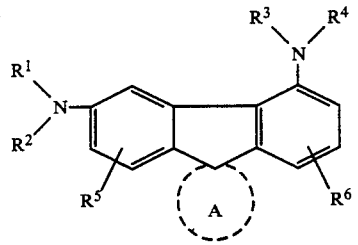

(I)

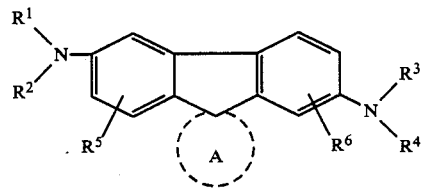

(II)

wherein $R^1$, $R^2$, $R^3$ and $R^4$, which may be the same or different, each represents an alkyl group, an alkenyl group, an alkynyl group, an aryl group, or a hydrogen atom; $R^5$ and $R^6$ each represents a hydrogen atom, a halogen atom, an alkyl group, an alkoxy group, an acyl group, a substituted amino group, a cyano group, a nitro group, an alkylthio group, or an aryl group; and ring A represents a heterocyclic ring having an aromatic ring as the partial skeleton.

In formulae (I) and (II) described above, $R^1$ and $R^2$ or $R^3$ and $R^4$ may combine with each other to form a ring having a hetero atom or an unsaturated bond.

Each of the groups shown by $R^1$, $R^2$, $R^3$, and $R^4$ in the aforesaid formulae may further be substituted by a substituent such as an alkyl group, an alkynyl group, an alkoxy group, an alkylthio group, an aryl group, an aryloxy group, a halogen atom, a nitro group, a cyano group, a substituted amino group, a substituted carbamoyl group, a substituted sulfamoyl group, a substituted oxycarbonyl group, a substituted oxysulfonyl group, and a heterocyclic ring. The aforesaid groups shown as substituents may further have a substituent.

Specific examples of the groups shown by $R^1$, $R^2$, $R^3$, and $R^4$ are —H, $-CH_3$, $-C_nH_{2n-1}XY$, $-C_nH_{2n-3}XY$, $-C_nH_{2n-3}$,

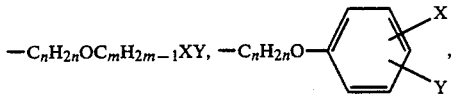

-continued

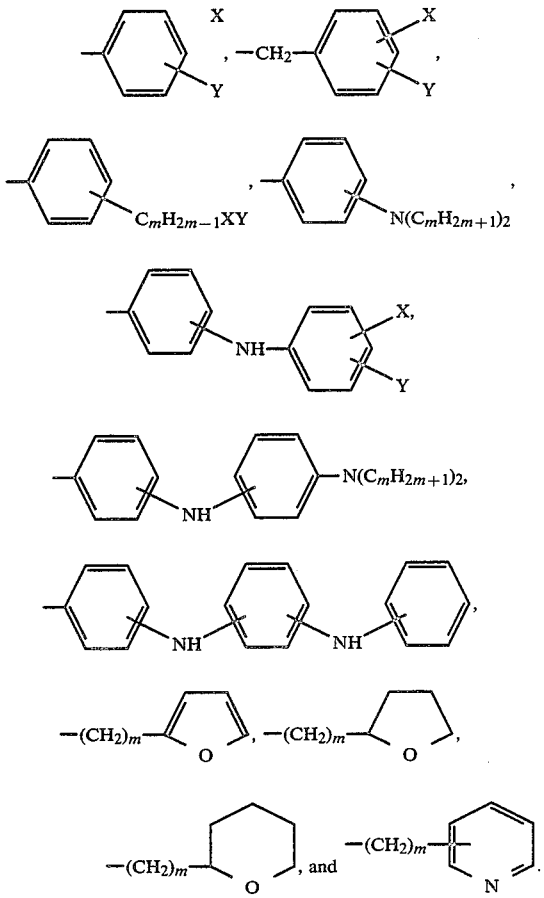

In the above formulae, n represents an integer of from 2 to 10; m represents an integer of from 1 to 5; and X and Y, which may be the same or different, each represents a hydrogen atom, a halogen atom, an alkyl group, an aryl group, an alkoxy group, a nitro group, a cyano group, or a substituted amino group.

When $R^1$ and $R^2$ or $R^3$ and $R^4$ in formula (I) or (II) described above form a ring, preferred examples of

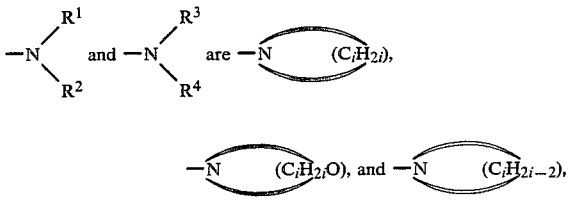

wherein i represents an integer of from 4 to 7.

Also, specific examples of the group shown by $R^5$ or $R^6$ in the aforesaid formulae (I) and (II) are preferably a hydrogen atom, a halogen atom, $-C_jH_{2j+1}$, $-OC_jH_{2j+1}$, $-SC_jH_{2j+1}$, $-NO_2$, $-C\equiv N$,

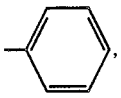

and $-N(C_jH_{2j+1})_2$, wherein j represents an integer of from 1 to 10.

The heterocyclic ring shown by A in the aforesaid formulae is preferably a ring shown by formula (III):

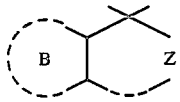

(III)

wherein B represents an aromatic ring which can contain one or more hetero atoms and Z represents a group necessary for forming a 5- or 6-membered ring having at least one hetero atom.

Specific examples of the aromatic ring shown by B in formula (III) described above are a benzene ring, a naphthalene ring, a pyridine ring, a pyrimidine ring, a pyrazine ring, a pyran ring, a thiazole ring, an imidazole ring, an oxazole ring, a pyrrole ring, an indole ring, a thiophene ring, a furan ring, a benzofuran ring, a quinoline ring, and a benzothiophene ring.

The aforesaid groups may be further substituted by an alkyl group, an aryl group, a substituted amino group, a halogen atom, a hydrogen atom, a nitro group, a cyano group, an alkoxy group, etc.

Among the rings, a benzene ring, a benzene ring having a substituted amino group or an alkoxy group, a pyridine ring, and a pyrazine ring are particularly preferred for B in formula (III).

Specific examples of the group shown by Z in

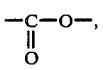

(i)

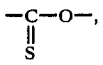

(ii)

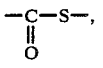

(iii)

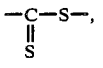

(iv)

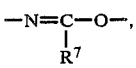

(v)

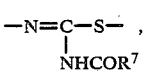

(vi)

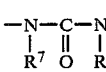

(vii)

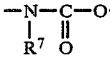

(viii)

and

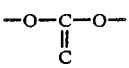

(xi)

wherein $R^7$ represents a hydrogen atom, an aryl group, an alkyl group or a perfluoroalkyl group and $R^8$ represents an alkyl group, an aryl group or an acyl group. In these groups, groups (i), (ii), (iii), (v) and (vi) are preferred and groups (i) and (v) are particularly preferred.

The heterocyclic ring shown by formula (III) bonds to the fluorene derivative shown by formula (I) or (II) as follows.

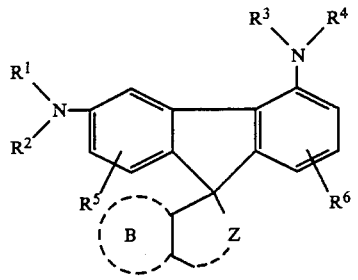

(I')

-continued

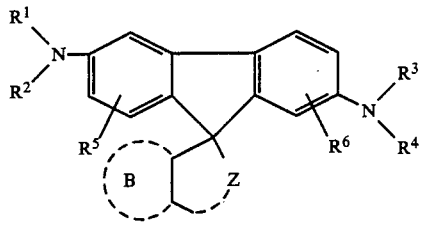

(II'')

Then, specific examples of the fluorene derivative for use in this invention are illustrated below but they are not limited to the following compounds.

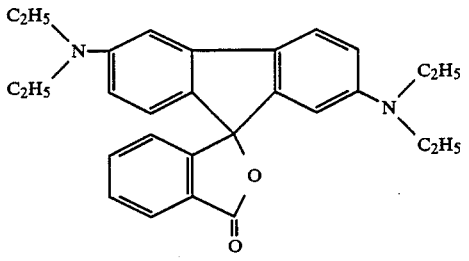

(1)

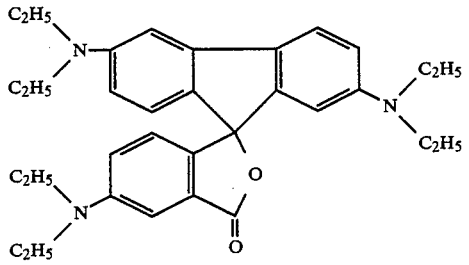

(2)

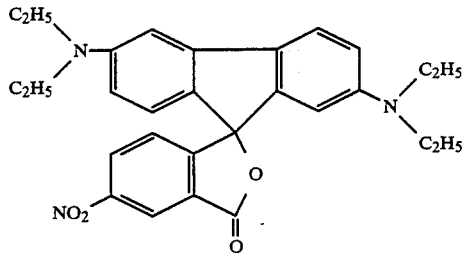

(3)

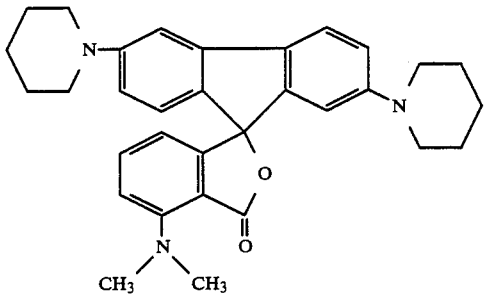

(4)

-continued
(5)
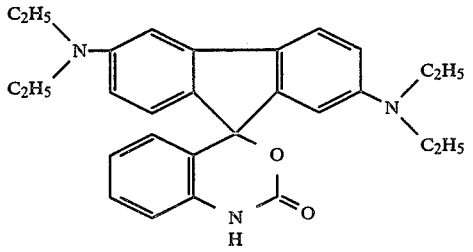
(6)
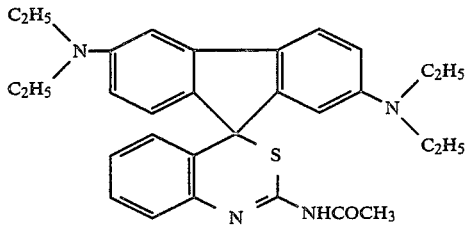
(7)
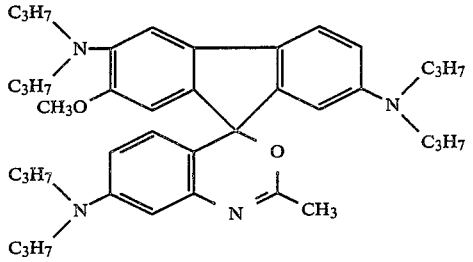
(8)
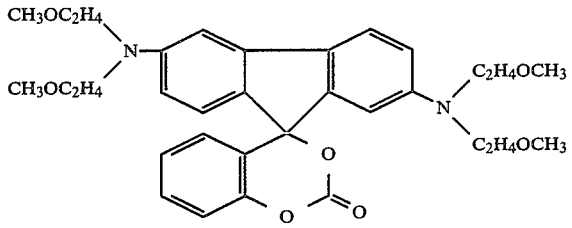
(9)
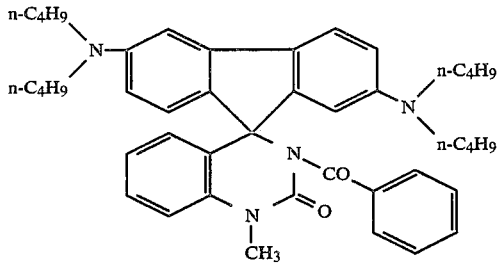
(10)
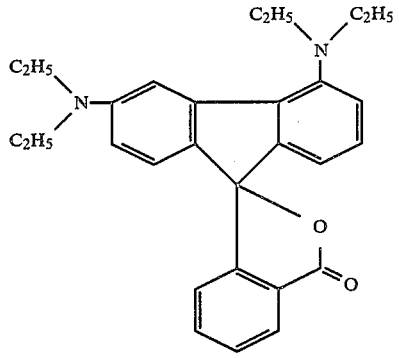

-continued
(11)
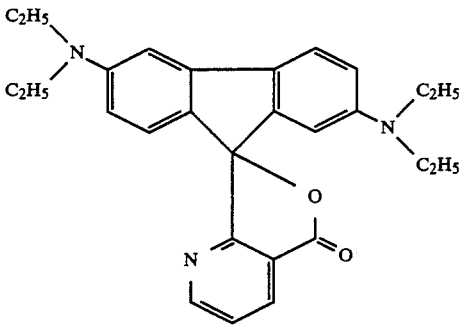
(12)
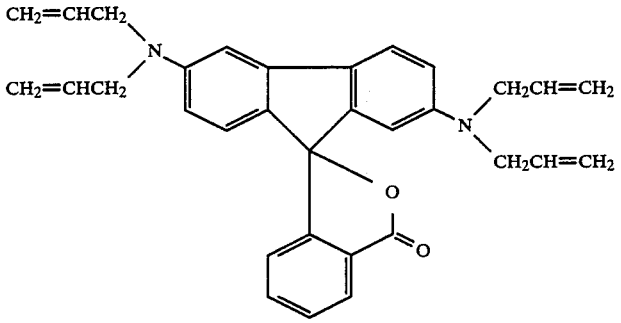
(13)
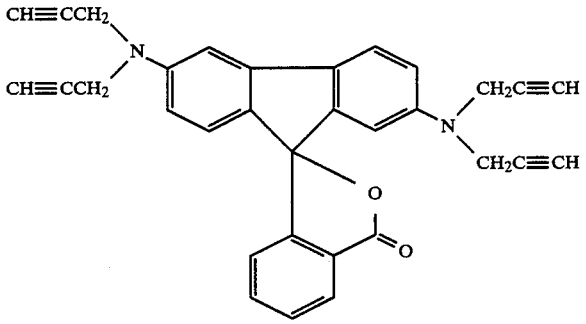
(14)
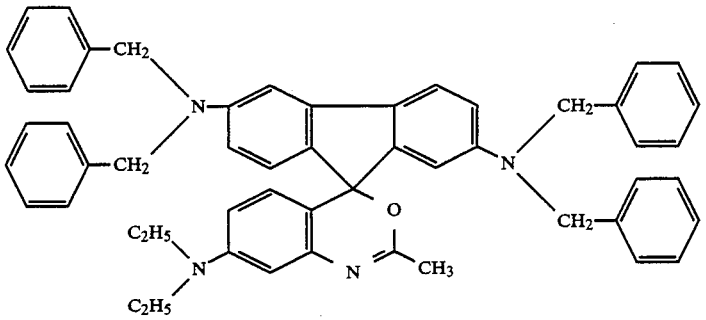
(15)
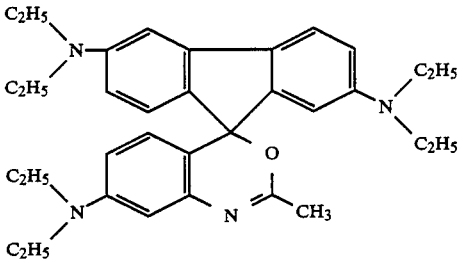

-continued
(16)
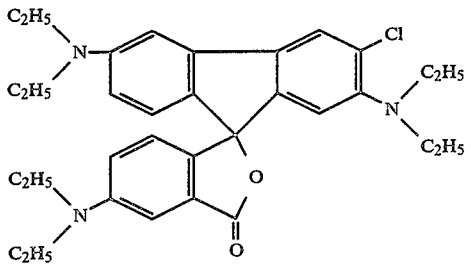
(17)
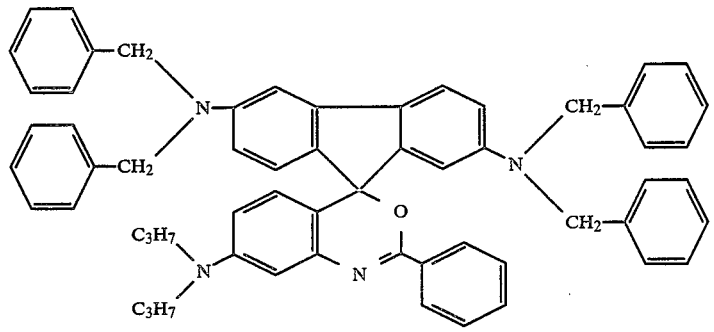
(18)
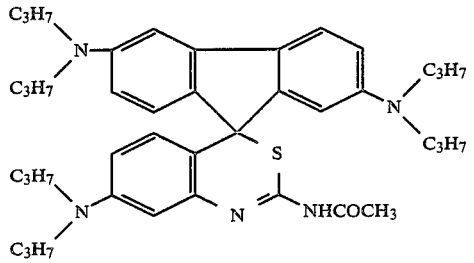
(19)
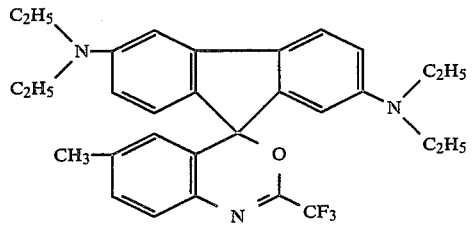
(20)
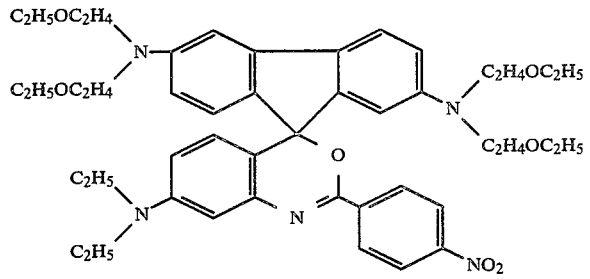

-continued
(21)
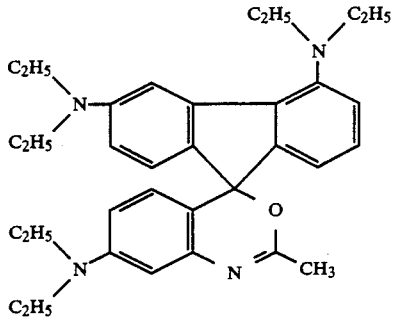
(22)
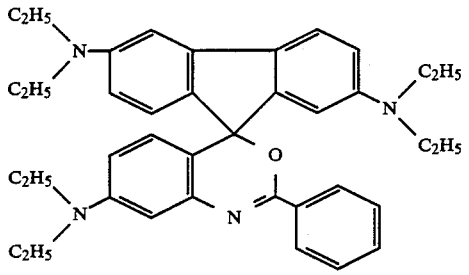
(23)
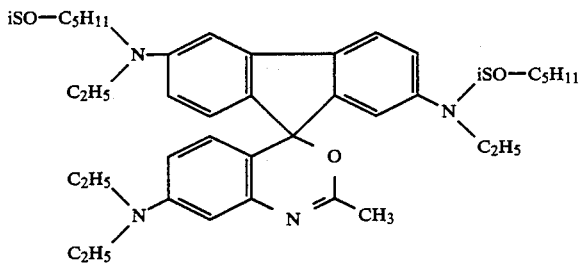
(24)
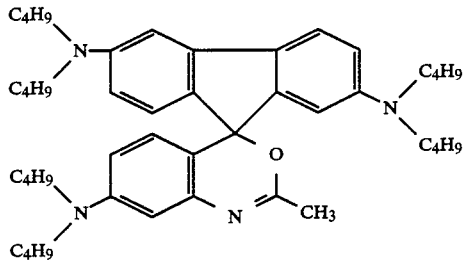
(25)
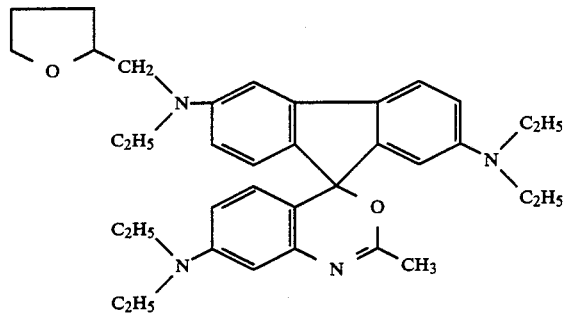

-continued (26)

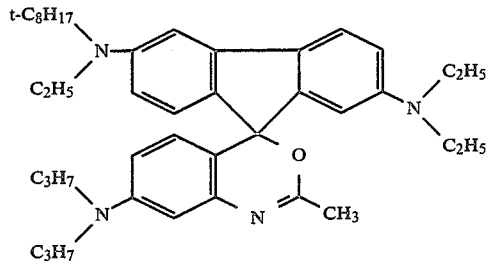

The fluorene derivatives for use in this invention can be obtained by various synthesis methods.

For example, a fluorene derivative is obtained by alkylating 2,6-(or 3,5-)diaminofluorenone to form a 2,6-(or 3,5-)disubstituted aminofluorenone and then subjecting the intermediate product to a dehydration condensation with a dialkylaminobenzoic acid, etc.

Thus, from the intermediate products, i.e., corresponding 2,6-(or 3,5-)di-substituted aminofluorenones, compounds (1) to (26) described above can be obtained.

Synthesis examples of the fluorene derivatives for use in this invention are shown below.

SYNTHESIS EXAMPLE 1

Synthesis of Exemplary Compound (2)

After dissolving 3.2 g of 2,6-bis(diethylamino)-9-fluorenol in a mixture of 7 ml of methanol, 14 ml of water and 5 ml of concentrated hydrochloric acid, 1.9 g of metadiethylaminobenzoic acid was added thereto and the resultant mixture was refluxed for 3 hours. The reaction mixture thus obtained was poured into 200 ml of ice-water and after alkalified the mixture with an aqueous diluted sodium hydroxide solution, the reaction product was extracted with chloroform. The chloroform layer thus formed was collected, dried, and concentrated to provide 7.5 g of a crude reaction product.

The crude product thus obtained was dissolved in a mixture of 20 ml of acetic acid and 20 ml of methanol and after properly heating the mixture, 2.4 g of chloranil was added thereto. After refluxing for 5 hours, the reaction mixture was poured into 200 ml of ice-water and the solution was alkalified with a diluted aqueous sodium hydroxide solution. Precipitates thus formed were collected by filtration and purified by column chromatography to provide 2.6 g of Compound (2).

Compound (2) was colored into black purple on silica gel and the colored dye had $\lambda_{max}$ at 850 nm and 720 nm.

SYNTHESIS EXAMPLE 2

Synthesis of Exemplary Compound (14)

After dissolving 5.7 g of 2,6-bis(dibenzylamino)-9-fluorenol and 0.1 g of methanesulfonic acid in 20 ml of chloroform, 2.1 g of meta-diethylaminoacetanilide was added to the solution at room temperature and the mixture was refluxed for 3 hours.

Then, by following the same procedure as in Synthesis Example 1 using the reaction mixture thus obtained, 5.2 g of Compound (14) was obtained.

Compound (14) was colored into black purple on silica gel and the colored dye had $\lambda_{max}$ at 715 nm.

These fluorene derivatives may be used singly but a mixture of two or more may be used for controlling the hue and preventing fading of colored images.

These fluorene derivatives may be used as a mixture with other known electron-donating colorless dye(s), such as triphenylmethane phthalide compounds xanthene compounds including fluoran compounds and rhodaminelactam compounds, phenothiazine compounds, indolyl phthalide compounds, diphenylmethane compounds including leucoauramine compounds, triazene compounds, spiropyran compounds, fluorene compounds, etc. In this case, it is preferred to use a mixture of two kinds of materials each showing black hue.

Specific examples of the phthalide compounds described above are described in U.S. Reissue Pat. No. 23,024, U.S. Pat. Nos. 3,491,111, 3,491,112, 3,491,116 and 3,509,174. Specific examples of the fluoran compounds are described in U.S. Pat. Nos. 3,624,107, 3,627,787, 3,641,011, 3,462,828, 3,681,390, 3,920,510, and 3,959,571. Specific examples of the spiropyran compounds are described in U.S. Pat. No. 3,971,808. Specific examples of the pyridine and pyrazine compounds are described in U.S. Pat. Nos. 3,775,424, 3,858,869, and 4,246,318. Specific examples of the fluorene compounds are described in Japanese Patent Application No. 240989/86.

Then, the colorless dyes which can be used in this invention are illustrated below.

Examples of triphenylmethane compounds are 3,3-bis(p-dimethylaminophenyl)-6-dimethylaminophthalide (i.e., Crystal Violet Lactone), 3,3-bis(p-dimethylaminophenyl)phthalide, 3-(p-dimethylaminophenyl)-3-(1,3-dimethylindol-3-yl)phthalide, 3-(p-dimethylaminophenyl)-3-(2-methylindol-3-yl)phthalide, etc. Examples of diphenylmethane compounds are 4,4'-bis-dimethylaminobenzhydrin benzyl ether, N-halophenylleucoauramine, N-2,4,5-trichlorophenyl leucoauramine, etc. Examples of xanthene compounds are rhodamine-B-anilinolactam, rhodamine(p-nitroanilino)lactam, rhodamine B (p-chloroanilino)lactam, 2-dibenzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-o-chloroanilino-6-diethylaminofluoran, 2-m-chloroanilino-6-diethylaminofluoran, 2-(3,4-dimethylanilino)-6-diethyl-aminofluoran, 2-octylamino-6-diethylaminofluoran, 2-dihexylamino-6-diethylaminofluoran, 2-m-trifluoromethylanilino-6-diethylaminofluoran, 2-butylamino-3-chloro-6-diethyl-aminofluoran, 2-ethoxyethylamino-3-chloro-6-diethylamino-fluoran, 2-p-chloroanilino- 3-methyl-6-dibutylaminofluoran, 2-anilino-3-methyl-6-dioctylaminofluoran, 2-anilino-3-chloro-6-diethylaminofluoran, pyridyl blue, 2-anilino-3-methyl-6-diisobutylaminofluoran, 2-phenyl-6-diethylaminofluoran, 2-anilino-3-methyl-6-N-ethyl-N-isoamylaminofluoran, 2-anilino-3-methyl-5-chloro-6-diethylaminofluoran, 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethyl-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-methyl-4',5'-dichlorofluoran, 2-o-toluidino-3-methyl-6-diisopropylamino-4',5'-dimethylaminofluoran, 2-anilino-3-ethyl-6-N-ethyl N-isoamylaminofluoran, 2-anilino-3-methyl-6-N-ethyl-N-γ-pyridylpropylaminofluoran, 2-anilino-3-chloro-6-N-ethyl-N-isoamylaminofluoran, 2-p-anilinoanilino-6-dimethylaminofluoran, 3-p-anilinoanilino-7-methylfluoran, 3-p-p'-anilinoanilinoanilino-6-methyl-7-chlorofluoran, etc. Examples of thiazine compounds are benzoyl leucomethylene blue, p-nitrobenzoyl leucomethylene blue, etc. Examples of spiro compounds are 3-methyl-spiro-dinaphthopyran, 3-ethyl-spiro-dinaphthopyran, 3,3'-dichloro-spiro-dinaphthopyran, 3-benzyl-spirodinaphthopyran, 3-methyl-naphtho-(3-methoxybenzo)spiropyran, 3-propyl-spiro-dibenzopyran, etc. And also, examples of fluorene compounds are 3,6-bis-diethylamino-5-diethylaminospiro(isobenzofuran-1,9'-fluorene)-3-one, 3',6'-bisdiethylamino-7-diethylamino-2-methylspiro(1,3-benzoxazine-4,9'-fluorene), 3,6'-bisethylamino-7-diethyl-aminospiro(2-hydro-1,3-benzoxadine-4,9'-fluorene)-2-one, 3-diethylamino-6-(N-methyl-N-allylamino)fluorene-9-spiro-3'-(6'-dimethylamino)-phthalide, 3-dimethylamino-6-(N-ethyl-N-ethoxyethylamino)-fluorene-9-spiro-3'-(6'-dimethylamino)-phthalide, etc.

The electron-accepting compounds for use in this invention are preferably shown by the following formula (IV) to (VIII):

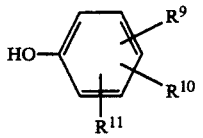

(IV)

wherein $R^9$ and $R^{10}$, which may be the same or different, each represents a hydrogen atom, an alkyl group, an alkoxy group, an aryl group, an arylsulfonyl group, an alkoxycarbonyl group, or a halogen atom and $R^{11}$ represents a hydrogen atom of a group represented by the following formula (IX):

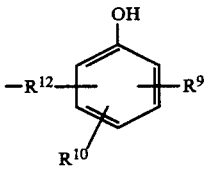

(IX)

wherein $R^9$ and $R^{10}$ are same as defined above as to formula (IV) and $R^{12}$ represents a divalent group having 1 to 12 carbon atoms or $SO_2$.

In the compounds represented by formula (IV) described above, the compounds wherein $R^{11}$ is a hydrogen atom and $R^9$ and $R^{10}$ are a hydrogen atom or an alkoxyoarbonyl group or the compounds wherein $R^{11}$ is the group represented by formula (IX) and $R^{12}$ in formula (IX) is an alkylene group having from 3 to 12 carbon atoms, a cycloalkylene group having from 5 to 7 carbon atoms, an aralkyl group having from 8 to 12 carbon atoms, or $SO_2$ are preferred.

In formula (IV), the alkyl group is a saturated or unsaturated alkyl or cycloalkyl group and these groups may have a substituent such as an aryl group, an alkoxy group, an aryloxy group, a halogen atom, or a cyano group.

Specific examples of the electron-accepting compound represented by formula (IV) are 4-phenylphenol, bisphenolsulfone, p-phenylsufonylphenol, p-tolylsulfonylphenol, bis(3-vinyl-4-hydroxyphenyl)sulfone, 2,2-bis(3-vinyl-4-hydroxyphenyl)propane, bis-3-allyl-4-hydroxyphenyl-sulfone, hexyl-4-hydroxy benzoate, 2,2'-dihydroxyhiphenyl, 2,2'-bis(4-hydroxyphenyl)propane, 4-4'-isopyridenebis(2-methylphenol), 1,1-bis-(3-chloro-4-hydroxyphenyl)cyclohexane, 1,1-bis(3-chloro-4-hydroxyphenyl)-2-ethylbutane, 4,4'-sec-isooctylidenediphenol, 4,4'-sec-butylidenediphenol, 4-p-methylphenylphenol, 4,4'-isopentylidenediphenol 4,4'-methylcyclohexylidenediphenol, 4,4'-dihydroxydiphenylsulfide, 1,4-bis(4-hydroxycumyl)benzene, 1,3-bis(4'-hydroxycumyl)-benzene, 4,4'-thiobis(6-tert-butyl-3-methyl-phenol), 4,4'-dihydroxydiphenylsulfone, hydroquinone monobenzyl ether, 4-hydroxybenzophenone, 2,4-dihydroxybenzophenone, polyvinylbenzyloxycarbonylphenol, 2,4,4'-trihydroxybenzophenone, 2,2'4,4'-tetrahydroxybenzophenone, dimethyl-4-hydroxyphthalate, methyl 4-hydroxybenzoate, 2,4,4'-trihydroxydiphenylsulfone, 1,5-bis-p-hydroxyphenylpentane, 1,6-bis-p-hydroxyphenoxyhexane, tolyl 4-hydroxybenzoate, 4-hydroxybenzoic acid o-phenylbenzyl ester, phenylpropyl 4-hydroxybenzoate, phenethyl 4-hydroxybenzoate, p-chlorobenzyl 4-hydroxybenzoate, p-methoxybenzyl 4hydroxybenzoate, 4-hydroxybenzoic acid benzyl ester, 4hydroxybenzoic acid m-chlorobenzyl ester, 4-hydroxybenzoic acid β-phenethyl ester, 4-hydroxy-2',4'-dimethyldiphenylsulfone, β-phenethyl orsellinate, cynnamyl orsellinate, orsellic acid o-chlorophenoxyetyl ester, o-ethylphenoxyethyl orsellinate, o-ethylphenoxyethyl orsellinate, m-phenylphenoxyethyl orsellinate, 2,4-dihydroxy-benzoic acid β-3'-t-butyl-4'-hydroxyphenoxyethyl ester, 1-t-butyl-4-p-hydroxyphenylsulfonyloxybenzene, 4-N-benyl-sulfamoylphenol, 2,4-dihydroxybenzoic acid p-methylbenzyl ester, 2,4-dihydroxybenzoic acid-phenoxyethyl ester, 2,4-dihydroxy-6 methylbenzoic acid benzyl ester, and methyl bis-4-hydroxyphenylacetate.

Formula (V) is shown below:

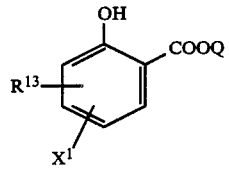

(V)

Wherein $R^{13}$ represents a hydrogen atom, an aryl group, or an alkyl group; $X^1$ represents an alkyl group, an alkoxy group, or a halogen atom; and Q represents a hydrogen atom or $M^{1/n}$ (wherein M represents an n-valent metal atom, and n represents an integer of from 1 to 3).

In formula (V), the alkyl group is a saturated or unsaturated alkyl or cycloalkyl group and these groups may have a substituent such as an aryl group, an alkoxy group, an aryloxy group, a halogen atom, an acylamino group, an aminocarbonyl group, a cyano group, etc.

Also, in formula (V), the aryl group is a phenyl group, a naphthyl group or a heterocyclic aromatic ring group and these groups may have a substituent such as an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, a phenyl group, etc.

In formula (V) described above, $R^{13}$ is preferably a hydrogen atom, a phenyl group, or an alkyl group having from 1 to 22 carbon atoms; $X^1$ is preferably an alkyl group having from 1 to 22 carbon atoms, an alkoxy group having from 1 to 22 carbon atoms, a chlorine atom or a fluorine atom; and M is preferably zinc, aluminum, magnesium, or calcium.

As the aforesaid substituent for the alkyl group and the alkoxy group shown by formula $X^1$, an aryl group having from 6 to 12 carbon atoms, an aryloxy group having from 6 to 16 carbon atoms, an alkoxy group having from 1 to 12 carbon atoms, a halogen atom, and an alkoxycarbonyl group are preferred.

The total carbon atom number of the salicylic acid derivative represented by formula (V) above for use in this invention is preferably at least 14, and particularly preferably at least 16 from the view point of water insolubility.

The salicyclic acid derivatives shown by formula (V) may be used as the form of a metal salt thereof or may co-exist with, for example, zinc oxide in a dispersion to cause salt formation, adsorption, or double decomposition.

Specific examples of the salicylic acid derivative shown by formula (V) include 4-pentadecylsalicylic acid, 3-phenylsalicylic acid, 3-cyclohexylsalicylic acid, 3,5-di-t-butylsalicylic acid, 3,5-di-dodecylsalicylic acid, 3-methyl-5-benzylsalicylic acid, 3-phenyl-5-(α,α-dimethylbenzyl) salicylic acid, 3,5-di(α-methylbenzyl)-salicylic acid, 3,5-di-t-octylsalicylic acid, 5-tetradecylsalicylic acid, 5-hexadecylsalicylic acid, 5-octadecylsalicylic acid, 5-α-(p-α-methylbenzylphenyl)ethylsalicylic acid, 4-dodecyloxysalicylic acid, 4-tetradecyloxysalicylic acid, 4-hexadecyloxysalicylic acid, 4-β-phenoxyethoxysalicylic acid, 4-β-p-tolyloxysalicylic acid, 4-β-p-ethylphenoxyethoxysalicylic acid, 4-β-p-methoxyphenoxyethoxysalicylic ACID, 4-β-p-ethoxyphenoxyethoxysalicylic acid, 4-β-m-tolyloxyethoxysalicylic acid, 4-β-o-tolyloxyethoxysalicylic acid, 4-(8-phenoxyoctyloxy)salicylic acid, etc.

Formula (VI) is shown below:

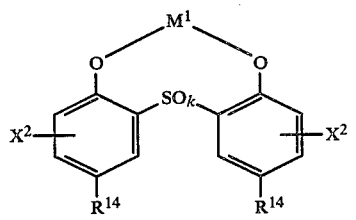

(VI)

wherein $R^{14}$ represents a hydrogen atom, an aryl group, an alkyl group, or a halogen atom; $X^2$ represents a hydrogen atom, an alkyl group, an alkoxy group, or a halogen atom; $M^1$ represents a divalent metal; and k represents an integer of from 0 to 2.

Specific examples of the compound shown by above formula (VI) include the zinc salt, nickel salt, magnesium salt, etc., of bis(2-hydroxy-5-butylphenyl)sulfone, bis(2-hydroxy-5-phenylphenyl)sulfone, bis(2-dhydroxy-5-octylphenyl)sulfone, bis(2-hydroxy-5-chlorophenyl)-sulfone, bis(2-hydroxy-3-chloro-5-butylphenyl)sulfone, etc.

Formula (VII) is shown below:

$$(R^{15})_2Zn(A^1)_2 \qquad \text{(VII)}$$

wherein $R^{15}$ represents a unidentate or polydentate colorless organic ligand bonded to the zinc ion through a hetero atom to form a complex and $A^1$ represents SCN, a chlorine atom, or a benzoic acid anion having an electron-attracting group.

The colorless organic ligands shown by $R^{15}$ are preferably a pyridine ligand, an imidazole ligand, a quinoline ligand, a benzothiazole ligand, a benzimidazole ligand, or an antipyrine ligand and these ligands may have a substituent such as an alkyl group, a cyano group, an alkoxy group, a phenyl group, an amino group, a formyl group, a vinyl group, etc.

Specific examples of the complexes shown by formula (VII) include an imidazole complex, 2-phenylimidazole complex, picoline complex, pyridine complex, 2-benzylimidazole complex, benzimidazole complex, 2,3-dimethyl-1-phenyl-3-pyrazolin-5-one complex, 1-phenyl-2-methyl-3-benzyl-3-pyrazolin-5-one complex, 1-phenyl-2-methyl-3-(2-ethyl-hexyl)-3-pyrazolin-5-one complex, 1-phenyl-2-methyl-3-isopropyl-3-pyrazolin-5-one complex, 1-phenyl-2,3-dibenzyl-pyrazolin-5-one complex, 1-phenyl-2-benzyl-3-methyl-pyrazolin-5-one complex, and 4,4'-diantipyrylmethane complex of zinc rhodanate.

Formula (VIII) is shown below:

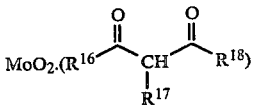

(VIII)

wherein $R^{16}$ and $R^{18}$, which may be the same or different, each represents an alkyl group, a substituted alkyl group, an aromatic ring which may contain a hetero atom, an alkoxy group or an aralkyl group and $R^{17}$ represents a hydrogen atom, an alkyl group or an aryl group.

Specific examples of the compound shown in formula (VIII) include an acetylacetone complex, 2,2,6,6-tetrmethyl-3,5-heptanedione complex, benzoylacetophenone complex, benzoylacetone complex, tetrafluoroacetylacetone complex, and 4,4,4-trifluoro-1-(2-thienyl)-1,3-butanediol complex of molybdic acid.

The above-described electron-accepting compounds can be used singly or as a mixture thereof. In the compounds described above, salicylic acid derivatives and metal salts are preferred and zinc acids are particularly preferred.

Since the recording material of this invention gives colored portions having light absorption at infrared regions, shows sufficient color density, and forms colored dyes which are very stable and cause scarcely discoloring and fading by light exposure, heating or humidifying for a long period of time, the recording material is particularly advantageous from the view point of long storage.

Also, when the recording material is used as a heat-sensitive recording material, there occur no faults that non-colored portions are colored by solvent, etc., and colored materials are discolored or faded by fats and oils, chemicals, etc., and hence the recording material of this invention has almost ideal performance.

When the recording material of this invention is used as a heat-sensitive paper, the electron donating colorless dye and the electron-accepting compound may be ground by dispersion in a dispersion medium into particle sizes of not more than 10 μm, and preferably not more than 3 μm. In this case, as a dispersion medium, an aqueous polymer solution of a concentration of from about 0.5 to 10 wt% is generally used and the dispersion is performed by using a ball mill, a sand mill, a horizontal type sand mill, an attritor, a colloid mill, etc.

In the recording materials of the present invention, the electron-accepting compound is preferably used in an amount of from 0.1 to 2 g/m$^2$.

The ratio of the electron-donating colorless dye to the electron-accepting compound is preferably from 1/10 to 1/1, and particularly preferably from 1/5 to 2/3 by weight. Also, for improving the heat respondence, a heat-fusible substance can be incorporated in the recording layer.

An example of the preferred heat-fusible substance is an ether derived from an aromatic alcohol.

There are, for example, ethers derived from phenols, naphthols, thiophenols, or thionaphthols each substituted by a group having not more than 8 carbon atoms such as a hydrogen atom, an alkyl group, an allyl group, an aryl group, an acyl group, a halogen atom, an alkoxy group, an alkylthio group, a cyano group, an alkoxycarbonyl group, a hydroxy group, etc.

An example of the heat-fusible substance is shown by the following formula (X):

$$Ar—X^3—R^{19} \quad (X)$$

wherein Ar represents an aromatic ring; $X^3$ represents —O— or —S— and $R^{19}$ represents an alkyl group which may be substituted. The aromatic ring shown by Ar may have one or more substituents such as a group having not more than 8 carbon atoms (e.g., a hydrogen atom, an alkyl group, an allyl group, an aryl group, an acyl group, a halogen atom, an alkoxy group, an alkylthio group, a cyano group, an alkoxycarbonyl group, or a hydroxy group) and when the ring has two or more substituents, these substituents may combine with each other to form a 5- to 7-membered ring which may have hetero atom.

Further, esters, acid amides, or ureas may also preferably be used as the heat-fusible substance.

Acid amides or ureas include the compounds derived from aliphatic or aromatic carboxylic acids or sulfonic acids.

These compounds are shown by following formulae (XI) to (XIII):

$$R^{20}YNHR^{21} \quad (XI)$$

$$R^{20}YOR^{21} \quad (XII)$$

$$R^{20}NHYNHR^{21} \quad (XIII)$$

wherein $R^{20}$ and $R^{21}$, which may be the same or different, each represents a hydrogen atom, an alkyl group, or an aryl group and these groups may be substituted by one or more groups selected from a halogen atom, an alkoxy group, an alkyl group, an aryl group, an aryloxy group, a hydroxy group, an acyl group, an alkoxyoarbonyl group, a substituted amino group, a carbamoyl group, and a sulfamoyl group, and Y represents —CO—, —SO—, or —$SO_2$—. It is preferred that at least one of $R^{20}$ and $R^{21}$ is a group having an aromatic ring or a long chain alkyl group.

Specific examples of the compound shown by formula (X), (XI), (XXI), or (XIII) described above are phenoxyethyl biphenyl ether, phenethylbiphenyl, benzyloxynaphthalene, benzylbiphenyl, di-m-tolyloxyethane, β-phenoxyethoxyanisol, 1-phenoxy-2-p-ethylphenoxyethane, bis-β-(p methoxyphenoxy)-ethoxymethane, 1-2'-methylphenoxy-2-4''-ethylphenoxyethane, 1-tolyloxy-2-p-methylphenoxyethane, 1,2 difluorophenoxyethane, 1,4-diphenoxybutane, bis-β-(p-methoxyphenoxy) ethyl ether, 1-phenoxy-2-p-chlorophenoxyethane, 1-2'-methyl-phenoxy-2-4''-ethyloxyphenoxyethane, 1-4'-methylphenoxy-2,4''-fluorophenoxyethane, 1-phenoxyethane, 1-phenoxy-2-p-methoxyphenyl thioether, 1,2-bis-p-methoxyphenyl thioether, 1-tolyloxy-2-p-methoxyphenyl thioether, 1,3-bis-p-tolyloxypropane, 1,3-bis-p-chlorophenoxypropane, 1,1,3-tris-phenoxyhexane, 1,4-bis-p-tolyloxybutane, 1,4-bis-p-chlorophenoxybutane, 1,2-bisphenoxyethane, 1,2-bis-p-tolyloxyethane, 1,2 bis-p-chlorophenoxyethane, 1,2-bis-p-methoxyphenoxyethane, 1,4-bis-α-naphthyloxybutane, 1,6-bis-phenoxyhexane, 1,3-bisphenoxy-2-benzyloxypropane, bis(2-p-tolyloxyethyl) ether, 1,1,3-trisphenoxybutane, bis(β-3,5-dimethylphenoxy-ethyl) ether, bis-(β-4-benzyloxycarbonylphenoxyethyl) ether, 1-phenoxy-2-p-ethylphenoxyethane, bis(2-β-naphthyloxyethyl) ether, 1,2 bis-2-(p-tolyloxy) ethoxy ethane, 1,2-bis {2-(3,5-dimethylphenoxy)ethoxy}ethane, 1-phenoxy-2-p-chlorophenyloxyethane, 1,2-bis{2-β-naphthyloxyethoxy}-ethane, bis{2-p-tolyloxyethoxy}methane, bis{2-(2,4,6-trimethyllphenoxy)ethoxy} methane, 1-phenoxy-2-β-naphthyloxy-propane, bis{2-β-naphthyloxyethoxy}methane, bisphenoxymethyl sulfide, bis(2-phenoxyethyl) sulfide, 1,3-bisphenoxymethylbenzene, 1,2-bisphenoxymethylbenzene, bisphenoxymethyl ether, 1-phenoxy 2-p-ethylthiophenoxyethane, 1,3,5-trisphenoxyethoxybenzene, 1-phenoxy-2-p-tolyloxyethane, 1-phenoxy-2-β-naphthyloxypropane, 1-p-tolyloxy-2-p-chlorophenoxyethane, 1,3-diphenoxy-2-propanol, 4-(2-phenoxyethoxy)-benzoic acid methyl ester, 1,2-bis(phenylthio)ethane, 1,2-bis(4-methoxyphenylthio)ethane, 1,2-bis(3-methoxyphenylthio)ethane, 1,2bis(4-methylphenylthio)ethane, 1,2-bis(2-methylphenylthio)ethane, 1,2-bis(4-methylphenylthio)-propane, 1-(4-methylphenylthio)-2-(4-methoxyphenylthio)ethane, 1,4-bis(4-methoxyphenylthio)-butane, 1,6-bis(4-methylphenylthio)hexane, 1,5-bis-β-naphthoxy-3-thioxapentane, bis[2'-4-methoxyphenylthio)-ethyl]sulfide, bis[2-(4methylphenylthio)ethyl]ether, 2,2'-bis[2-(phenylthio)-ethyl]diethyl sulfide, 1,2-bis(2-naphthylthio)ethane, stearic acid amide, stearic acid anilide, stearic acid p-aniside, stearic acid o-aniside, ethylenebisstearoamide, methylol stearoamide, phenylacetic acid amide, phenoxyacetic acid amide, p-methoxyphenoxyacetic acid amide, phenoxypropionic acid amide, phenoxyacetic acid anilide, phenoxybutyric acid anilide, phenylpropionic acid amide, phenoxyacetic acid benzylamide, phenoxyacetic acid phenethylamide, 2-ethylhexanoic acid anilide, stearylurea, hexylurea, N'-phenylhexylurea, N-stearyl-N'-phenylurea, 2-phenoxy-1-p-methoxyphenylthioethane, 2 p-tolyloxy-1-p-methoxyphenylthioethane, β-naphthylphenoxy acetate, β-naphthoxyacetic acid phenoxyethyl ester, β-phenoxyethylbenzoyl propionate, p-methoxyphenoxyethyl-p'methoxyphenoxy acetate, phenoxy-methylbenzodioxane, phenoxymethylnaphthodioxane, p-phenyl-phenol glycidyl ether, phenoxyethylhydroxy naphthoate, phenyl hydroxynaphthoate, 1,4-dibutoxynaphthalene, benzyl benzyloxybenzoate, phenyl benzoate, methoxycarbonylbenzoic acid amide, dihydroxybenzene diglycidyl ether, 2-(3,4-methylenedioxyphenoxy)-1-p-fluorophenoxyethane, diphenyl carbonate, ditolyl carbonate, and benzylnaphthyl carbonate.

The aforesaid heat-fusible substance(s) may be used singly or as a mixture thereof and for obtaining a sufficient heat respondence, the substance(s) are used in an amount of preferably from 10 to 200% by weight, and more preferably from 20 to 150% by weight based on the amount of the electron-accepting compound.

The coating composition containing the dispersion described above at a proper mixing ratio may contain various additives for meeting various requirements.

As examples of such additives, it has been practiced that an inorganic pigment or an oil absorptive material such as polyurea filler, etc., is dispersed in the binder for preventing stains of recording head at recording and further an aliphatic acid, a metal soap, etc., is added thereto for increasing the releasing property for head. Accordingly, the coating composition further contains additives such as a pigment, wax, an antistatic agent, a ultraviolet absorbent, a defoaming agent, an electric conducting agent, a fluorescent dye, a surface active agent, a hindered phenol, a benzoic acid derivative, etc., in addition to the aforesaid colorless dye and the electron-accepting compound, which take part in coloring and the coating composition is coated on a support to provide the recording material of this invention.

Examples of the pigment are kaolin, calcined kaolin, talc, zinc white, aluminum hydroixide, magnesium hydroxide, calcined plaster, silica, magnesium carbonate, titanium oxide, alumina, barium carbonate, barium sulfate, mica, microballon, urea-formalin filler, polyethylene particles, cellulose filler, etc., having a particle size of from 0.1 to 15 μm.

Examples of wax are paraffin wax, carboxy-modified paraffin wax, carnauba wax, microcrystalline wax, polyethylene wax, higher fatty acid ester, etc.

In the case of using an inorganic pigment, the amount thereof is preferably from 0.5 to 20 times, and particularly preferably from 1 to 10 times the weight of the electron-accepting compound.

Examples of metal soap are polyvalent metal salts of higher fatty acids, such as zinc stearate, aluminum stearate, calcium stearate, and zinc oleate.

As the hindered phenol, a phenol derivative substituted by a branched alkyl group at at least one of the 2- and 6-positions thereof.

Example of the hindered phenol are 1,1-bis(2-methyl-4-hydroxy-5-t-butyl-phenyl)butane, 1,1,3-tris(3-methyl-4-hydroxy-5-t-butylphenyl)butane, bis(2-hydroxy-3-t-butyl-5-methylphenyl)methane, and bis(2-methyl-4-hydroxy-5-t-butylphenyl) sulfide.

The above-described additives are coated on a support as a dispersion in a binder.

As the benzoic acid derivative, a metal salt of benzoic acid having at least one electron-attracting group is preferred and practical examples thereof are zinc salts, aluminum salts, cadmium salts, magnesium salts, and calcium salts of halogen substituted benzoic acid, nitrobenzoic acid, cyanobenzoic acid, substituted sulfonylbenzoic acid, acylbenzoic acid, substituted carbamoylbenzoic acid, alkoxycarbonylbenzoic acid, and substituted sulfamoylbenzoic acid. In particular, the zinc salts are preferred. These salts can be also used as electron-accepting compounds. They may be used singly or as a mixture thereof.

As the binder, a water-soluble binder is generally used and there are polyvinyl alcohol, hydroxyethyl cellulose, hydroxypropyl cellulose, epichlorohydrin modified polyamide, an ethylene-maleic anhydride copolymer, a styrene-maleic anhydride copolymer an isobutylene maleic anhydride copolymer, polyacrylic acid, polyacrylic acid amide, methylol-modified polyacrylamide, starch derivatives, casein, gelatin, etc.

The coating composition can further contain a water resisting agent (e.g., gelling agent, crosslinking agent, etc.) or an emulsion or hydrophobic polymer such as a styrene-butadiene rubber latex, an acryl resin emulsion, etc., for imparting water resistance to the binder.

The coating composition is coated on a base paper, a wood free paper, a synthetic paper, a plastic sheet, or a neutral paper at an amount of from about 2 to 10 g/m$^2$.

Furthermore, a protective layer composed of a water-soluble or water-dispersible polymer such as polyvinyl alcohol, hydroxyethyl starch, and epoxy-modified polyacrylamide and a crosslinking agent is formed on the coated layer at a thickness of from about 0.2 to 2 μm for improving the resistance thereof.

In the case of applying the present invention to a heat-sensitive paper, there are various embodiments as described in West German Patent Application (OLS) Nos. 2,228,581 and 2,110,854, and Japanese Patent Publication No. 20142/77. At recording, pre-heating, humidity control or stretching of coating paper can be applied.

The support which can be used in the present invention includes not only paper but any other supports generally employed in the art, such as various non-woven fabrics, plastic films, synthetic paper, and composite sheets thereof.

The following examples are intended to illustrate the present invention but not to limit it in any way.

EXAMPLE 1

By dispersing each 8 g of Compound (1), 8 g of 2-anilino-3-chloro-6-diethylaminofluoran, and 2 g of 3,6'-bisdiethylamino-5-diethylaminospiro(isobenzofuran-1,9'-fluorene)-3-one (electron-donating colorless dyes); 20 g of zinc 4-β-p-methoxyphenoxyethoxysalicylate (electronaccepting compound); and 10 g of 2-benzyloxynaphthalene and 15 g of stearic acid amide (heat-fusible substances) with 100 g of an aqueous solution of 5% polyvinyl alcohol (Kuraray PVA 105, trade name, made by Kuraray Co., Ltd.) by a ball mill for twenty-four hour to prepare each dispersion having a volume mean particle size of 3 μm.

On the other hand, 80 g of amixture of calcium carbonate and zinc oxide in an equivalent weight was dispersed together with 160 g of an aqueous solution of 0.5% sodium hexametaphosphate by means of a homogenizer.

Then, after mixing 5 g of the electron-donating colorless dye dispersion, 10 g of the electron-accepting compound dispersion, 5 g of the heat-fusible substance dispersion, and 22 g of the dispersion of calcium carbonate and zinc oxide prepared as described above, 4 g of an emulsion of zinc stearated and 5 g of an aqueous solution of 2% sodium (2-ethylhexyl)sulfosuccinate were added to the mixture solution to obtain a coating composition. The coating composition was coated on a wood free paper having a basis weight of 50 g/m$^2$ at a dry thickness of 6 g/m$^2$ by means of a wire bar, dried for 5 minutes by an oven at 50° C., and subjected to calender treatment to provide a coated paper.

When the coated paper was colored using high speed facsimile FF-2000 (trade name, made by Fujitsu Limited), black images were obtained. The colored images had light absorption at an infrared region. Also, when each of filter papers was impregnated with ethanol or castor oil and each paper was superposed on the colored surface of the recording paper thus colored as above described, almost no far formation at white portions and no color vanish (discoloring and fading) of the colored portion were observed.

On the other hand, when the coated paper was stored for 24 hours under high temperature and high humidity (60° C., 30% RH or 40° C., 90% RH), almost no fog formed.

EXAMPLES 2 to 6

By following the same procedure as Example 1 except that the following materials were used in place of the electron-donating colorless dyes and the electronaccepting compound in Example 1, each of coated papers was obtained.

EXAMPLE 2

Electron-donating colorless dye: 8 g of Compound (1), 8 g of 2-anilino-3-methyl-6-N-ethyl N-isoamylaminofluoran, and 1 g of 3',6'-bisdiethylamino-5-diethylaminospiro (isobenzofuran-1,9'-fluorene)-3-one.

Electron-accepting compound: 10 g of 1,4-bis(p-hydroxycumyl)benzene, 8 g of zinc salt of bis(2-hydroxy-5biphenyl)sulfone, and 4 g of benzimidazole complex of zinc rhodanate.

EXAMPLE 3

Electron-donating colorless dye: 10 g of Compound (3) and 10 g of 2-anilino-3-methyl-6-N-ethyl-N-isoamylamaino-fluoran.

Electron-accepting compound: 8 g of 1,1-bis(4hydroxyphenyl)cyclohexane, 8 g of zinc 4-β-p-methoxyphenoxyethoxysalicylate, and 4 g of 1-phenyl-2,3-dimethyl-3-pyrazolin-5-one complex of zinc rhodanate.

EXAMPLE 4

Electron-donating colorless dye: 10 g of Compound (7) and 10 g of 2-anilino-3-chloro-6-diethylaminofluoran.

Electron-accepting compound: 10 g of acetylacetone complex of molybdenic acid and 10 g of bisphenol sulfone.

EXAMPLE 5

Electron-donating colorless dye: 10 g of Compound (14) and 10 g of 2-anilino-3-methyl-6-N-ethyl N-isoamylaminofluoran.

Electron-accepting compound: 20 g of zinc 4-β-p-methoxyphenoxyethoxysalicylic acid.

EXAMPLE 6

Electron-donating colorless dye: 10 g of Compound (15) and 10 g of 2-anilino-3-methyl-6-N-ethyl-N-isoamyl aminofluoran.

Electron-accepting compound: 16 g of 4,4'-isopentylidenediphenol and 4 g of 1-phenyl-2,3-dimethyl-3-pyrazolin-5-one complex of zinc rhodanate.

The colored images of these coated papers had light absorption at infrared regions and the formation of fog was less.

While the invention has been described in detail and with reference to specific embodiments thereof, it will be apparent to one skilled in the art that various changes and modifications can be made therein without departing from the spirit and scope thereof.

What is claimed is:

1. A recording material comprising a support having thereon a recording layer comprising at least one electron-donating colorless dye and at least one electron-accepting compound, wherein said electron-donating colorless dye is a fluorene derivative represented by the formula (II):

(II)

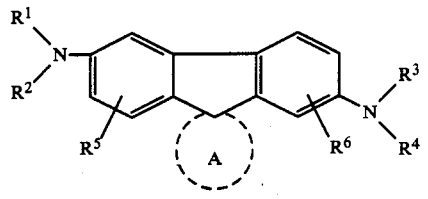

wherein $R^1$, $R^2$, $R^3$ and $R^4$, which may be the same or different, each represents an alkyl group or a substituted alkyl group; $R^5$ and $R^6$ each represents a hydrogen atom, a halogen atom, an alkyl group, an alkoxy group, an acyl group, a substituted amino group, a cyano group, a nitro group, an alkylthio group, or an aryl group and ring A is selected from (i)

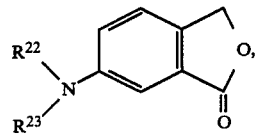

(ii)

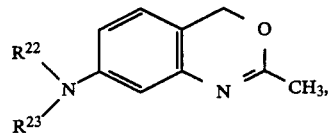

(iii)

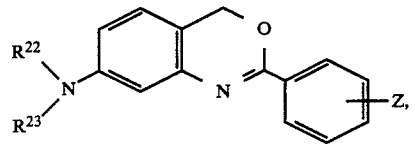

and (iv)

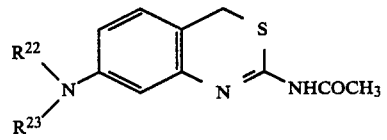

wherein $R^{22}$ and $R^{23}$ each represents a methyl group, an ethyl group, a propyl group or a butyl group, and Z represents a hydrogen atom or a nitro group.

2. A recording material as in claim 1, wherein $R^1$ and $R^2$ or $R^3$ and $R^4$ combine with each other to form a ring having a hetero atom or an unsubstituted bond.

3. A recording material as in claim 1, wherein $R^{22}$ and $R^{23}$ each represents an ethyl group, a propyl group or a butyl group.

4. A recording material comprising a support having thereon a recording layer comprising at least one electron-donating colorless dye and at least one electron-donating compound, wherein said electron-donating colorless dye is a fluorene derivative represented by formula (A) or formula (B):

(A)

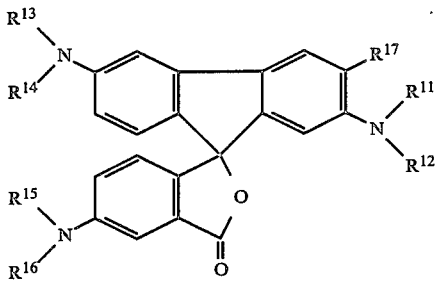

wherein $R^{11}$, $R^{12}$, $R^{13}$, $R^{14}$, $R^{15}$, and $R^{16}$ each represents an alkyl group, and $R^{17}$ represents a hydrogen atom or a chlorine atom;

(B)

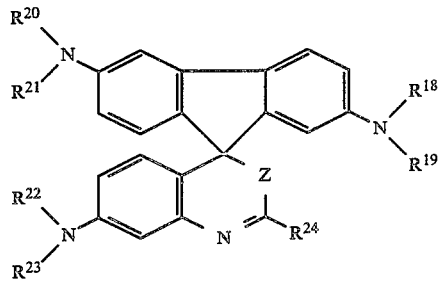

wherein $R^{18}$, $R^{19}$, $R^{20}$ and $R^{21}$, which may be the same or different, each represents an alkyl group or an aralkyl group, $R^{22}$ and $R^{23}$, which may be the same or different, each represents an alkyl group, $R^{24}$ represents an alkyl group, an aryl group or an acylamino group, and Z represents an oxygen atom or a sulfur atom.

* * * * *